United States Patent [19]

Rariden et al.

[11] Patent Number: 4,726,635

[45] Date of Patent: Feb. 23, 1988

[54] HANGING FILE FOLDER SUPPORT ASSEMBLY FOR DRAWERS

[75] Inventors: Stewart Rariden; David H. Rariden, both of Bedford, Ind.

[73] Assignee: Stone City Products, Inc., Bedford, Ind.

[21] Appl. No.: 901,797

[22] Filed: Aug. 29, 1986

[51] Int. Cl.[4] ..... A47B 63/00

[52] U.S. Cl. ..... 312/184; 220/22.1; 312/183

[58] Field of Search ..... 206/425; 220/22.1; 312/183, 184, 330

[56] References Cited

U.S. PATENT DOCUMENTS

| | | | |
|---|---|---|---|
| 3,614,185 | 10/1971 | Splan | 312/184 |
| 3,748,008 | 7/1973 | Pryor | 312/184 |
| 3,788,718 | 1/1974 | Bjorn et al. | 312/184 |
| 3,860,119 | 1/1975 | Irvine et al. | 211/45 |
| 3,938,870 | 2/1976 | Guest et al. | 312/184 |
| 3,977,527 | 8/1976 | Rose et al. | 211/46 |
| 3,999,663 | 12/1976 | Walter et al. | 211/175 |
| 4,176,753 | 12/1979 | Godfrey | 211/182 |
| 4,219,247 | 8/1980 | Litchfield et al. | 312/184 |
| 4,234,238 | 11/1980 | Figueroa | 312/184 |
| 4,262,808 | 4/1981 | Laporte | 211/46 |
| 4,262,810 | 4/1981 | Ilich | 211/206 |
| 4,475,657 | 10/1984 | Albery | 211/46 |
| 4,489,836 | 12/1984 | Terrell | 211/46 |
| 4,526,277 | 8/1985 | Snowden et al. | 211/46 |

FOREIGN PATENT DOCUMENTS

| | | | |
|---|---|---|---|
| 1149331 | 5/1963 | Fed. Rep. of Germany | 312/184 |
| 177091 | 3/1922 | United Kingdom | 312/184 |

*Primary Examiner*—Joseph Falk
*Attorney, Agent, or Firm*—Scott R. Cox

[57] ABSTRACT

A hanging file folder support assembly is provided comprising a pair of support rails securable to the sides of the drawer and a plurality of support bars spanning the distance between the side rails, said bars insertable in slots in the side rails. This system is adaptable to support hanging file folders which run between the sides of the drawer, parallel to the sides of the drawer or both. The system is also adaptable to support hanging file folders at or below the level of the top of the sides of the drawers.

1 Claim, 13 Drawing Figures

HANGING FILE FOLDER SUPPORT ASSEMBLY FOR DRAWERS

BACKGROUND OF INVENTION

1. Field of Invention

This invention relates to drawers and, more particularly, to drawers for office furniture containing a means for supporting hanging file folders.

2. Prior Art

In business desks and bureaus, it is important to provide efficient storage space for documents and files. Many earlier drawers were unable to efficiently store documents of different size and shape. Without the addition to the drawers of some means to arrange differently sized documents, the space within a drawer was poorly utilized and access to specific documents was difficult. Further, because of the various sizes of documents, such as letter size documents, which are approximately 11 inches in length, legal size documents, which are approximately 14 inches in length, and computer paper size documents, which are at least 17 inches in length, an efficient means for organizing, arranging and storing various sized documents within a single drawer was needed.

One method of solving this problem is a hanging file folder support which is secured within a drawer. U.S. Pat. No. 4,234,238 discloses a hanging file folder support which is adaptable for use in conventional storage drawers. The support consists of two type of alternative supporting rails; one for folders arranged parallel to the drawer side and one for folders that span the drawer sides. In one embodiment the spanning system is comprised of a pair of "h" shaped support rails which fit over the upper lip of the side walls of the drawer and run the length of the side walls. The support rails include an upstanding flange—the neck of the "h"—which actually supports the hooks of the hanging file folders, and support rails—the body of the "h"—which grip the side walls of the drawer by means of a ridged inner surface. In an alternative embodiment, the support rails are secured to the side walls by gripping clips. In this embodiment the hanging files are placed on the spanning rails. In both embodiments, this support rail system, secured by "gripping" clips, is only adaptable to drawer sides of a consistent thickness. Further, once a drawer is adapted for use for hanging folders which, for example, span the side walls of the drawer, that drawer may not be used to support hanging file folders which run parallel to the side walls of the drawer. In addition, the support rail securing clips used in this device may easily dislodge when the weight of the suspended folders on the upstanding flange becomes excessive.

U.S. Pat. No. 3,614,185 also discloses a device for supporting hanging file folders which fits over the edge of the side of a drawer. The device is secured to the sides of the drawers by a clamping means which can be easily dislodged. Further, the support rails of this device can only support suspended files which span the sides of the drawer.

U.S. Pat. No. 4,219,247 discloses a device to support hanging files for attachment to a specific type of drawer which has a low back, low sides, and a high front. This device is secured to the drawer sides by clips. The side rails of the assembly are preset in length and are not adaptable for use with common drawers where the sides and backs of the drawers are approximately the same height as is the drawer front. In addition, the spanning rails of this device are easily dislodged since they merely sit within slits in the top of side rails of the device.

U.S. Pat. No. 3,938,870 discloses another device for supporting hanging file folders which provides support only for hanging files which span the width of the drawer. While this system provides some latitude in the choice of thicknesses of the sides of the drawers, it will not support hanging folders which are either narrower or wider than the distance between the support rails.

Other support systems for hanging file folders are disclosed in U.S. Pat. Nos. 4,262,808 and 3,748,008. However both of these devices contain deficiencies similar to those previously disclosed.

There are also a large number of patents which disclose a hanging file support frame which is insertable within a drawer to support suspended folders including U.S. Pat. Nos. 4,526,277, 4,489,836, 4,475,657, 4,262,810, 4,176,753, 3,999,663, 3,977,527, 3,860,119 and 3,788,718. None of these suspended folder frame support devices are attachable to the side wall of the drawers. Also none are adaptable for the support of hanging file folders which both span the side walls of the drawers and run parallel to the side walls of the drawer. Thus, there is still a need for a hanging file folder support which can adapt to various document sizes while fully utilizing the space contained within a drawer.

Accordingly, it is an object of this invention to produce a hanging file folder support which is easily attachable to the drawers of desks and bureaus.

It is a further object of the invention to produce a hanging file support which can support hanging files both spanning the sides of the drawer and running parallel to the sides of the drawer.

It is another object of this invention to produce a hanging file support capable of supporting letter size, legal size, and computer size documents within the same drawer.

It is an additional object of this invention to produce a hanging file support which will not easily dislodge from the sides of a drawer.

It is a still further object of the invention to produce a hanging file support which will support hanging file folders, the tops of which are below the level of the sides of the drawer.

Other objects and features of the present invention will become apparent from consideration of the following description and the accompanying drawings in which a selected example of the construction of the invention is set forth to illustrate the invention.

SUMMARY OF INVENTION

In accordance with the present invention, there is provided a hanging file folder support assembly for drawers comprising:

a. a pair of hanging file folder support rails secured by a securing means to the side of a drawer, each rail containing a plurality of slots, and;

b. a plurality of hanging file folder support bars spanning the side walls of the drawers which are insertable in the slots of the hanging file folder support rails.

DESCRIPTION OF DRAWINGS

The invention will now be described with reference to the accompanied drawings.

DETAILED DESCRIPTION OF INVENTION

Figure 4:
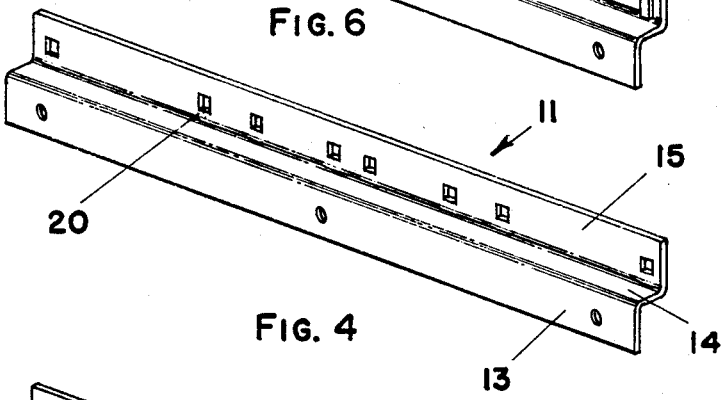
FIG. 4 is a side perspective view of one of the hanging file folder support rails included in FIGS. 1, 2, and 3.
Figure 5:
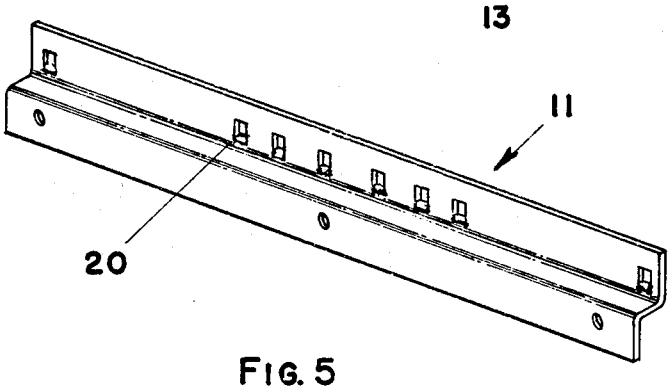
FIG. 5 is an alternative side perspective view of the hanging file folder support rail showing that the bottom edge of the slots is located approximately at the same height as the middle flat portion of the rails.
Figure 7:
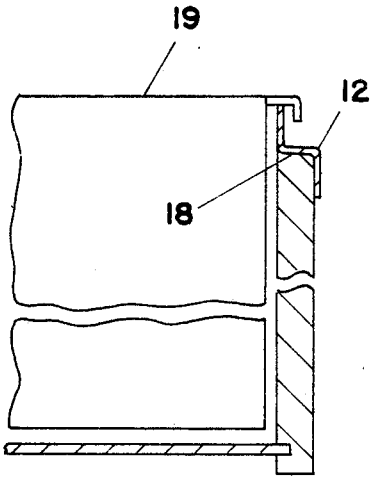
FIG. 7 is a cross section view of a hanging file folder support rail attached to a drawer.

Although the invention is adaptable to a wide range of applications, it is shown in the drawings for the purpose of illustration as a hanging file folder support assembly (10) for drawers which includes two parallel hanging file folder support rails (11, 12) and a plurality of hanging file folder support bars (21) spanning the rails. In a preferred embodiment the rails are shaped like a ⊢ with a lower vertical side (13), a middle flat portion (14) and an upper support flange (15) (See FIG. 4). Each of the rails is shaped such that the lower vertical side (13) rests flat against the outside side edge of a side (16) of a drawer (17). The middle flat portion (14) rests on the top edge (18) of the side of the drawer. The upper support flange (15) projects upward from the inside edge of the middle flat portion (14) of the support rail. Although the rail may be constructed from any conventional material such as metal or plastic, in a preferred embodiment the rails are steel.

The lower vertical portion of the rail (13) is secured to the outside edge of the drawer by any conventional securing means. When the drawer is of wooden construction the rail may be secured by screws, bolts, nails, or any conventional securing means. When the drawer construction is metal, the rails may be secured by metal screws, rivets, bolts, welding techniques or any other conventional securing means.

The middle flat portion of the rail (14) which rest on the upper edge of the drawer may be the same width as the upper edge of the drawer or it may be slightly larger or smaller. Its principal function is to provide support for the rail.

Figure 1:
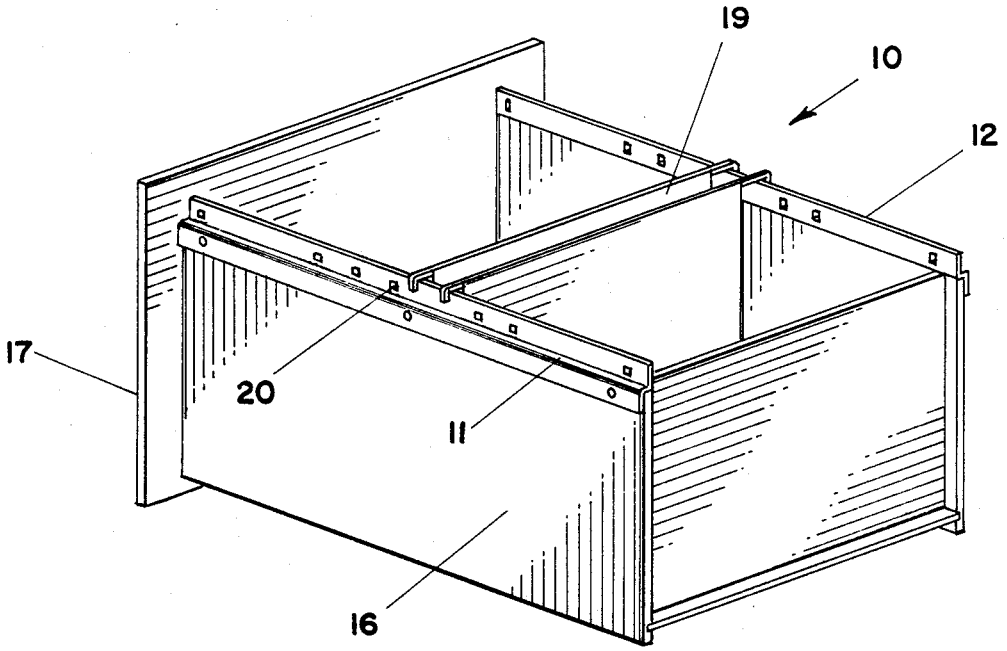
FIG. 1 is a rear perspective view of a drawer showing the instant invention with hanging file folders spanning the side walls of the drawer.
Figure 2:
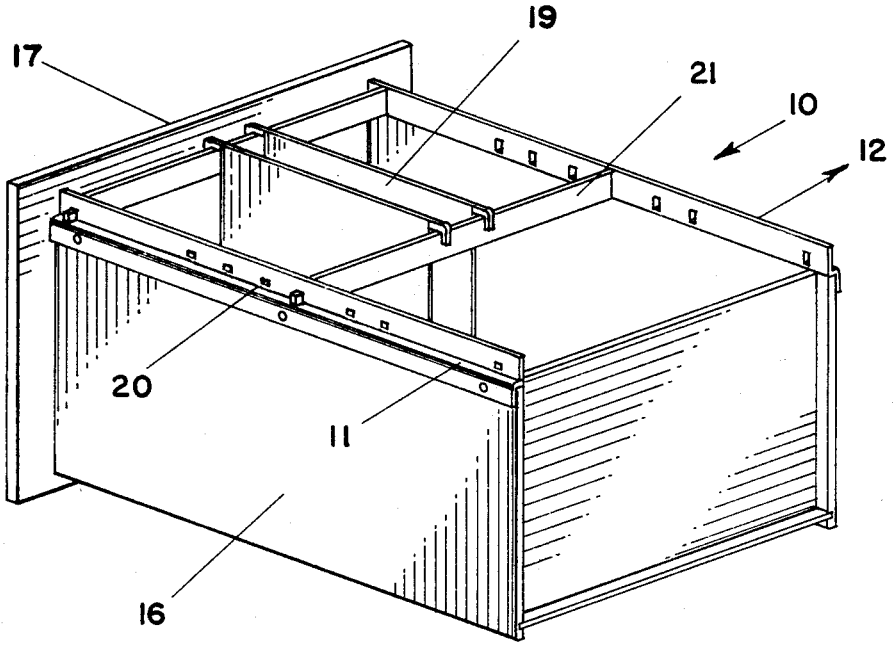
FIG. 2 is a rear perspective view of a drawer showing the hanging file folders parallel to the sides of the drawer.
Figure 3:
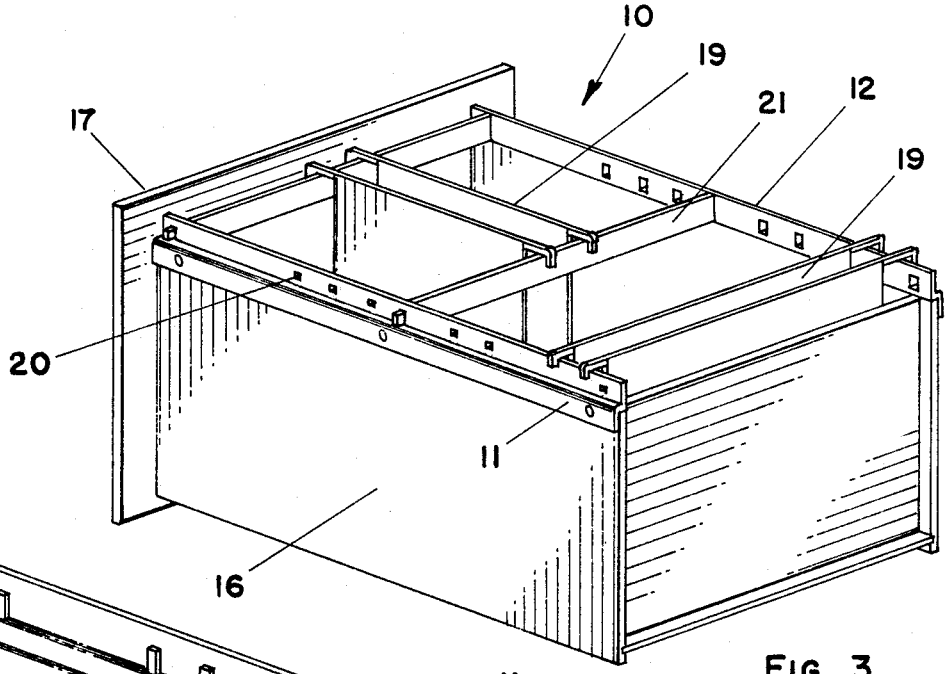
FIG. 3 is a rear perspective view of a drawer showing suspended folders both spanning the sides of the drawer and parallel to the sides of the drawer.
Figure 6:
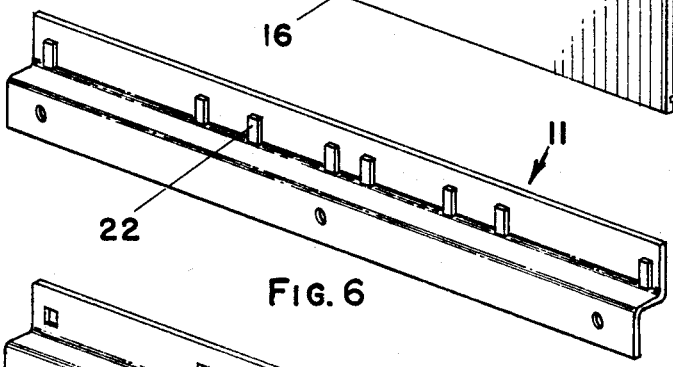
FIG. 6 is a side perspective view of a hanging file folder support rail showing slots which can be selectively knocked out.

The upper support flange (15) supports the hanging file folders (19) and prevents them from sliding off of the rail. The upper support flange (15) also contains a plurality of slots (20) into which a hanging file folder support bar (21) which span the distance between the rails, is inserted. These slots (20) may be located at any convenient place on the rails. There should be sufficient slots to allow for the support bars (21) to be an appropriate distance apart to support any size hanging file folder. For example, if the hanging file folders are approximately 17 inches apart, slots in the upper support flange should be 17 inches apart to allow insertion of the bars to support the folders. Slots in the side rails which are established at various distances apart should be present to allow for different size hanging file folders. The slots may also be located at regularly spaced intervals, such as one inch apart, to allow for the presetting of the support bars on assembly of the drawer. It is not crucial that the slots be completely punched out. For appearance and utility, partially prepunched slots (22) may be used (See FIG. 6).

Figure 10:
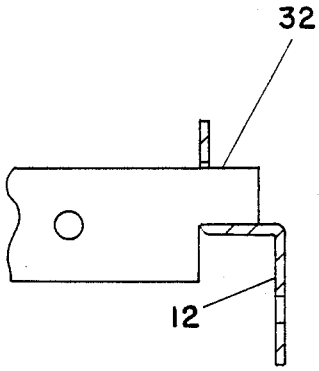
FIG. 10 is a cross sectional view of a third alternative embodiment hanging file folder support bar.

The slots (20) may be located at any convenient height within the support flange (15). In normal operation, the slots are centered on the upper support flange. However, if desired, the slot may be located so that its bottom edge is the same height as the middle flat portion of the rail (See FIG. 10). This allows the support bars to be inserted at the lowest possible height on the rail to provide additional height above the bar for tabs or other vertical protrusion either on the hanging file folders themselves or on documents within the hanging file folders. The slots may be of any convenient shape although in a preferred embodiment, the slots are rectangular.

Figure 11:
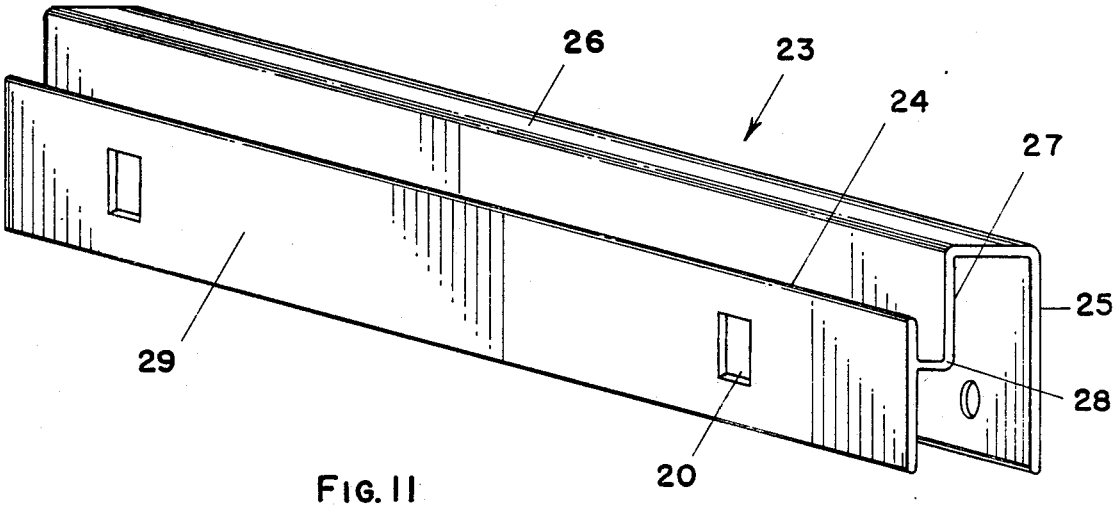
FIG. 11 is a side perspective view of an alternative embodiment of a hanging file folder support rail.
Figure 13:
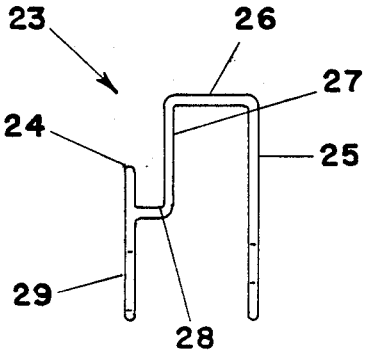
FIG. 13 is a cross sectional view of an alternative embodiment to FIG. 12.
Figure 12:
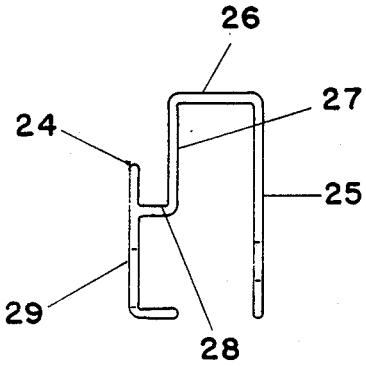
FIG. 12 is a cross sectional view of FIG. 11.

In an alternative embodiment the support rail may be chair shaped (23) ⊓ with the support flange (24) projecting upward from the inner edge of the chair (See FIGS. 11, 12, and 13). The back of the chair shaped support rail (25) is secured by conventional means to the outside edge of the drawer side. The flat top surface of the support rails (26) will again rest on the top edge of the drawer side. The inner side of the chair shaped support rail (27) will project downward into the drawer. The edge (28) of the chair shaped support rail projects inward from the drawer side. Attached to this "chair seat" shaped projection (28) is the inner leg (29) of the support rail. The inner leg (29) may project downward only (See FIG. 13) or in an alternative embodiment the leg may bend inward to contact the inner surface of the drawer to provide additional support for the support rod. (See FIG. 12). The inner leg (29) of the support rail should project inward a sufficient distance to allow the insertion of the support bars through the slots of the rail (20). The inner leg (29) should be located at least about ½ of an inch from the inner surface of the side of the drawer. The inner side of the support rail may project downward any convenient length up to about 2 inches. This alternative embodiment may be used in those situations where the top of the side of the drawer is at or near the top of the opening in the desk or bureau into which the drawer is inserted. By this alternative arrangement, file folders will not hit the top of the opening in the desk when the drawer is closed.

Spanning the side walls of the drawer are a plurality of hanging file folders support bars (21), the ends of which are inserted in the slots in the support rails. These support bars may be of any conventional shape ranging from about ¼ of an inch up to 1 inch in height and of any conventional thickness such as about ⅛ of an inch. The length of the bar will be determined by the distance between the support rails (11, 12) which are secured to the sides of the drawer. Different sized bars can be produced to fit different needs.

Figure 8:
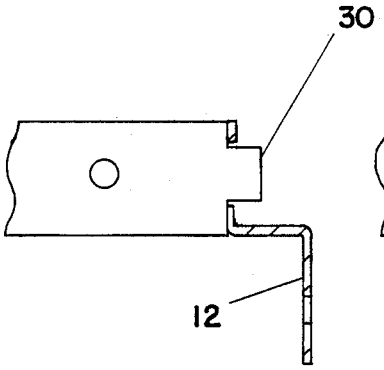
FIG. 8 is a cross sectional view of a hanging file folder support bar.
Figure 9:
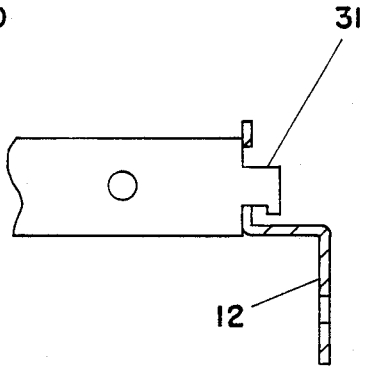
FIG. 9 is a cross sectional view of a second embodiment of a hanging file folder support bar.

The ends of the bars are inserted within the slots of the support rails prior to securing both support rails to the sides of the drawer. The ends of the bars may be shaped to easily fit within the slots in the support rails and, in addition, for certain specialized uses. For example, the ends may be formed by cutting out rectangular shaped sections from the top and bottom edge of the bar to produce a rectangular-shaped tip (31) narrower than the height of the rest of the bar. (See FIG. 8). In an alternative embodiment, (See FIG. 9) a rectangle slit is cut in the bottom of the bar away from the end of the bar and in the top of the bar (31). This enables the bar to lock into position between the rails and prevents the movement of the bars. The slits may be any convenient distance from the end of the bar from about ⅛ of an inch to about 1 inch. This embodiment also provides additional support for the rails and helps reduce vibration and noise within the drawer. In another alternative embodiment, a rectangular section is removed only from the bottom of the bar (See FIG. 10). Again the tip of the bar (32) fits within the slots of the support rails. However this specialized arrangement of the tip of the bar and the slot allows the bar to rest as low as possible within the hanging file folder support assembly. This type of bar would be used to support suspension folders in a drawer with a minimum of overhead clearance.

In use, a support rail is secured to the side of a wooden drawer by a securing means such as a set of screws. The appropriate type of support bar is chosen and the end of that bar is inserted in an appropriately located slot of the rail. The other end of the bar is inserted in a parallel slot in the other rail. Repeating this procedure, all chosen bars are inserted in both rails. The second rail is then secured to the other side of the drawer by screws. The bars should be arranged in appropriately chosen locations within the drawer to support the hanging file folders. For example, the bars are placed in slots chosen to allow for the hanging file folders to be placed either parallel to the sides of the drawer or spanning the sides of the drawer. In a further embodiment, the bars may be located to allow hanging file folders to be utilized both parallel to the sides and spanning to the sides of the drawer. By carefully selecting the location of the bars, the use of the space within the drawer can be optimized. The hanging file folder device can be used to store letter size, legal size, and computer size paper. This system provides great utility and is adaptable for use in most types of drawers.

What is claimed is:

1. A hanging file folder support assembly comprising:

a. a wooden drawer consisting of a rectangular bottom, a front panel, a back panel and two side panels, each panel of which is connected at the lower ends thereof to the rectangular bottom, said drawer providing storage space;

b. a pair of one-piece metal support rails, one of which is connected to the top end of each of the drawer side panels, each of said support rails comprised of a vertical portion secured by screws to the upper outside of one of the side wall panels of the drawer, a flat portion resting on the top of the side wall panel of the drawer connected to the vertical portion, and an upper support flange connected to the flat portion which projects upward above the level of the drawer side panels, wherein said rails are adaptable for use with side wall panels of any thickness and wherein said rails are capable of supporting hanging file folders, and wherein each of said upper support flanges contain a plurality of spaced slots; and c. a plurality of metal support bars spanning the side wall panels of the drawer wherein the ends of the support bars are narrower than the body of the support bars to fit within the slots of the upper support flanges, each of said bars capable of supporting one end of a hanging file folder.

* * * * *